US006901721B2

(12) United States Patent
Spatafora

(10) Patent No.: US 6,901,721 B2
(45) Date of Patent: Jun. 7, 2005

(54) UNIT FOR OVERWRAPPING PACKETS

(75) Inventor: Mario Spatafora, Bologna (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 10/428,113

(22) Filed: May 2, 2003

(65) Prior Publication Data

US 2003/0205025 A1 Nov. 6, 2003

(30) Foreign Application Priority Data

May 6, 2002 (IT) ..... BO2002A0261

(51) Int. Cl.[7] ..... B65B 11/28
(52) U.S. Cl. ..... 53/234; 53/389.3
(58) Field of Search ..... 53/233, 234, 227, 53/389.3, 389.4

(56) References Cited

U.S. PATENT DOCUMENTS

| | | | | |
|---|---|---|---|---|
| 2,933,871 A | | 4/1960 | Brook | |
| 4,823,536 A | * | 4/1989 | Manservigi et al. | 53/234 |
| 4,918,901 A | * | 4/1990 | Gamberini et al. | 53/234 |
| 5,305,580 A | | 4/1994 | Draghetti | |
| 5,406,775 A | * | 4/1995 | Tacchi et al. | 53/389.4 |
| 5,442,894 A | * | 8/1995 | Ogata et al. | 53/234 |
| 5,461,841 A | * | 10/1995 | Spada et al. | 53/234 |
| 5,653,671 A | * | 8/1997 | Reuteler | 53/381.1 |
| 6,101,787 A | * | 8/2000 | Brintazzoli et al. | 53/234 |
| 6,219,995 B1 | * | 4/2001 | Boldrini et al. | 53/234 |
| 6,286,291 B1 | * | 9/2001 | Tale' et al. | 53/234 |

FOREIGN PATENT DOCUMENTS

| | | | | |
|---|---|---|---|---|
| DE | 4118763 | | 2/1992 | |
| EP | 0970887 | | 1/2000 | |
| GB | 22010769 | * | 7/1979 | 53/233 |
| GB | 2191166 | | 12/1987 | |

* cited by examiner

*Primary Examiner*—John Sipos
(74) *Attorney, Agent, or Firm*—Harbin King & Klima

(57) ABSTRACT

Packets are overwrapped in a cellophaner unit equipped with a wheel by which the packets are directed through an assembly station together with leaves of wrapping material and toward a folding station where the leaves are bent around the packets, also a suction roller set in rotation continuously and tangentially to the wheel, on which the leaves are held by suction while advancing along a first path extending between a cutter device and the assembly station; the wheel is furnished with peripheral carriers supporting the single packets, each equipped with gripper jaws positioned to take up one end of a leaf held on the adjacent roller and detach it by degrees from the relative suction surface before effecting an initial overwrapping step of folding the leaf partly around a relative packet.

18 Claims, 5 Drawing Sheets

UNIT FOR OVERWRAPPING PACKETS

BACKGROUND OF THE INVENTION

The present invention relates to a unit for overwrapping packets.

The invention finds application to advantage in the manufacture of tobacco products, relating as it does to the operation of overwrapping packets that contain such products, and in particular packets of cigarettes, to which reference is made explicitly throughout the following specification albeit with no limitation in general scope implied.

More particularly, the present invention relates to a unit for overwrapping packets substantially of rectangular prismatic geometry, delimited axially by two opposite end faces, and delimited laterally by two larger side faces and by two smaller side faces extending parallel to a longitudinal axis of the rectangular prism. The packets are overwrapped as they advance in a predetermined direction along a predetermined wrapping path.

Such units generally include feed devices serving to advance leaves of overwrapping material obtained by cutting a continuous strip of the material as it decoils from a relative roll.

Modern packaging machines are capable of notably high operating speeds, especially continuous motion cigarette packers of which the overwrapping units in question form a part. To ensure that products will emerge faultlessly overwrapped, therefore, it becomes more and more important that the leaves of overwrapping material remain under continuous and complete control as they are advanced by the feed devices, in order to avoid any kind of problem that could derive from incorrect positioning and loss of timing, causing the leaf to be applied defectively to the packet and producing an overwrap spoiled by unsightly creases or similar flaws.

The object of the present invention is to provide a unit for overwrapping packets such as will be able to fulfil the requirements mentioned above when operating at the high production tempo typical of a modern packaging machine.

SUMMARY OF THE INVENTION

The stated object is realized according to the invention in a unit for overwrapping packets, comprising a unit by which packets are transferred through an assembly station and there united with leaves of wrapping material, then toward a folding station where the selfsame leaves are bent around the packets, also feed means by which the leaves are caused to advance along a first path extending between a cutter device and the assembly station.

To advantage, the feed means are embodied as a conveyor set in motion continuously along the first path while restraining the leaves advanced along the selfsame path, and the transfer unit comprises a plurality of carriers supporting the packets, each equipped with means by which to grip one end of a leaf adhering to the conveyor and detach it progressively from the selfsame conveyor before effecting an initial overwrapping step of folding the leaf partly around a relative packet.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 5:
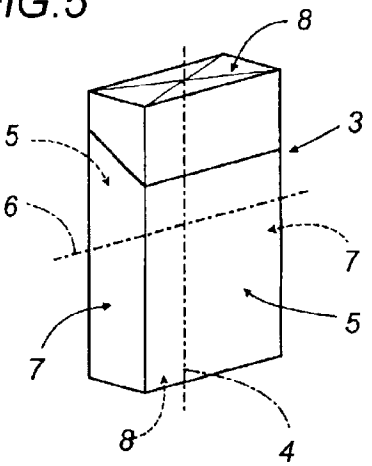
FIG. 5 shows a packet of cigarettes, illustrated schematically and in perspective, overwrappable by the unit of FIG. 1.

With reference to FIGS. 1 to 4 of the drawings, 1 denotes a portion of an overwrapping machine or cellophaner equipped with a unit 2 for overwrapping packets 3 of rectangular parallelepiped appearance, as illustrated in FIG. 5, each referable to a longitudinal axis 4 and presenting two mutually parallel larger side faces 5 parallel also with the longitudinal axis 4 and with a transverse axis 6, two mutually parallel smaller side faces 7 parallel also with the longitudinal axis 4, and two mutually parallel end faces 8 normal to the longitudinal axis 4.

The overwrapping unit 2 comprises a unit 9 by which the packets 3 are transferred through an assembly station 10 where a leaf 11 of wrapping material (normally polypropylene) is associated with each successive packet 3. The leaves 11 of material are directed into the station 10 from a conveyor 12, operating in conjunction with a pair of pinch rolls 13, by which a continuous strip 14 of the wrapping material is decoiled from a bulk roll (not illustrated), the single leaves 11 being generated by a cutter device 15 associated with the conveyor 12 and then carried along a first path 16 by the selfsame conveyor 12 toward the assembly station 10.

More exactly, as illustrated in FIGS. 1 to 4 and FIG. 7, the conveyor 12 consists in a suction roller 17 rotatable continuously about a respective axis 17*a* in a clockwise direction, denoted F1 in the drawings. The roller 17 presents a cylindrical surface 18 of revolution designed to retain both the leading end of the continuous strip 14 and the leaves 11 separated from the selfsame strip by the cutter device 15, which comprises an outer blade 19 positioned to interact with two strikers 20 mounted to the roller 17 in positions angularly equidistant one from the other. The same cylindrical surface 18 affords a plurality of radial holes 21 connected by way of conventional means to a source of negative pressure not illustrated in the drawings.

The transfer unit 9 comprises a folder wheel 22 driven continuously about an axis 22*a* disposed parallel to the axis 17*a* of the suction roller 17, rotating in a counterclockwise direction denoted F2 in the drawings. The wheel 22 is equipped with a plurality of carriers 23 equispaced angularly about the periphery, each serving to support a respective packet 3 and comprising a block 24 of U-profiled section, mounted pivotably to a respective shaft 25 anchored to the folder wheel 22 with its axis 25*a* parallel to the axis 22*a* of the selfsame wheel 22.

Each block 24 is furnished, internally, with a rigidly associated gripper 26 designed to receive a single packet 3, comprising two pivotably anchored jaws 27 rotatable about corresponding axes parallel to the axis 25*a* of the shaft 25, and externally, mounted to one of the two members of the U-profile, with means 28 by which to grip one end 11*a* of the leaf 11 of wrapping material held by the suction roller 17. Such gripping means 28 comprise a first movable jaw 29 hingedly associated with a pivot 30 disposed parallel to the axis 25*a* of the shaft 25, and a second fixed jaw 31 fastened directly to the corresponding member of the block 24, against which the first jaw locates.

Each block 24 can be made to pivot back and forth about the respective axis 25*a* through the agency of conventional actuator means (not indicated) acting directly on the corresponding shaft 25, whilst the folder wheel 22 also carries the selfsame blocks 24 along a second path 32 passing through the assembly station 10 substantially tangential to the first path 16.

During its progress along the second path 32, in particular, and within the dimensional compass of the overwrapping unit 2, each carrier 23 is capable of movement between two limit positions, of which a first coincides both with a position denoted 33, enabling the admission of a packet 3 at an entry station 33*a* into which successive packets 3 are directed by a feed device 34, shown schematically in FIGS. 1 to 4 as a block, such as will insert the packet 3 sideways-on between the jaws 27 of the gripper 26, and with a position denoted 35 in which the leaf 11 of material is bent partially around the packet 3 at a folding station 35*a*. In these two positions 33 and 35, both representing the first limit position, the jaws 27 extend substantially in a radial direction relative to the folder wheel 22, so that during the step of inserting the packet 3 between the jaws 27, which will be spread apart, the packet 3 can be translated parallel with its transverse axis 6 to the point at which one smaller side face 7 enters into contact with a locating surface 36 interposed between the jaws 27, assuming a position of maximum radial projection from the wheel 22.

The second of the two limit positions is assumed by the carrier 23 during its passage through the assembly station 10 and produces a configuration, for reasons that will become clear, in which the advancing packet 3 assumes a position of minimum radial projection from the wheel 22.

Figure 6:
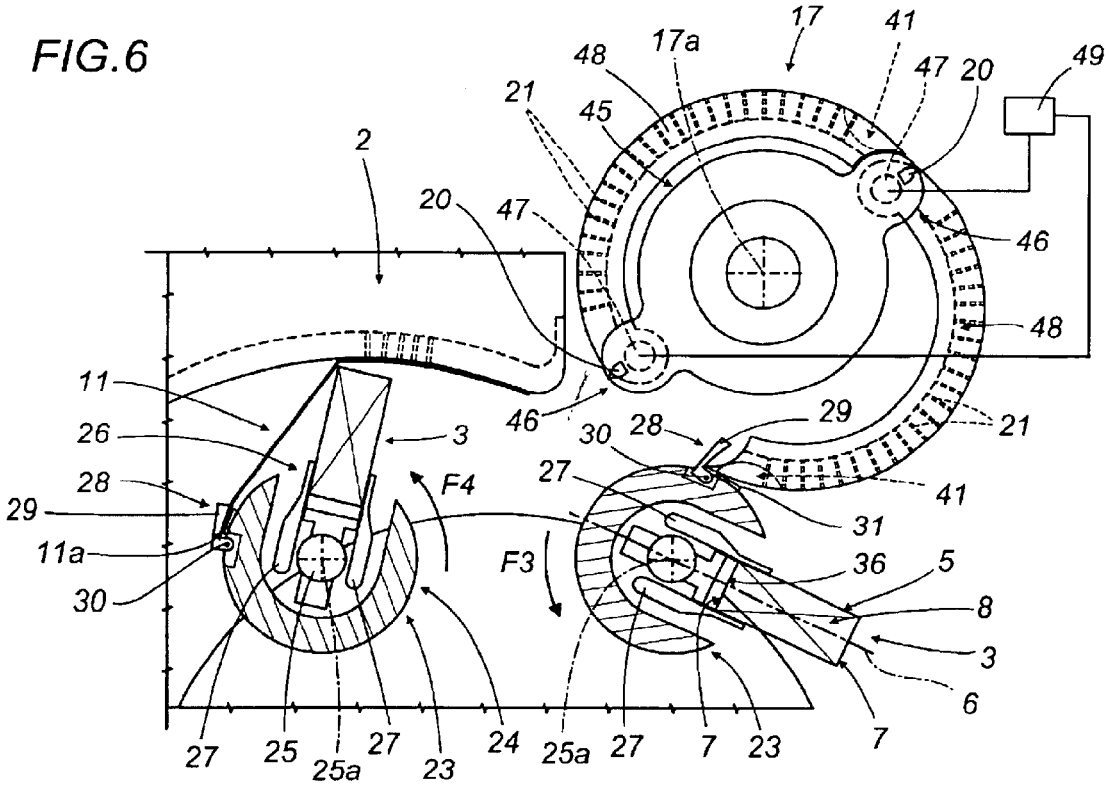
FIG. 6 shows a second preferred embodiment of the unit for overwrapping packets according to the invention, alternative to the first, illustrated schematically in a side elevation with certain parts omitted and seen in the same operating step as that of FIG. 3.

As illustrated in FIGS. 1 to 4 and in FIG. 6, the overwrapping unit further comprises stationary folder and guide means 37 positioned downstream of the assembly station 10, considered in relation to the direction of rotation F2 of the wheel 22, along which the folding position 35 is assumed by the carrier 23. In particular, the stationary folder and guide means 37 comprise a fixed restraint 38 extending concentrically with the axis 22*a* of the folder wheel 22 from a position immediately beyond the assembly station 10 to a transfer station of conventional embodiment, not illustrated, where the packets 3 and the relative leaves 11 are released.

More particularly, the side of the restraint 38 directed toward the folder wheel 22 presents an aspirating surface 39 fashioned with a plurality of uniformly distributed suction holes 40 such as will attract each advancing leaf 11 of wrapping material and smooth it over the corresponding smaller side face 7 of the relative packet 3.

Figure 2:
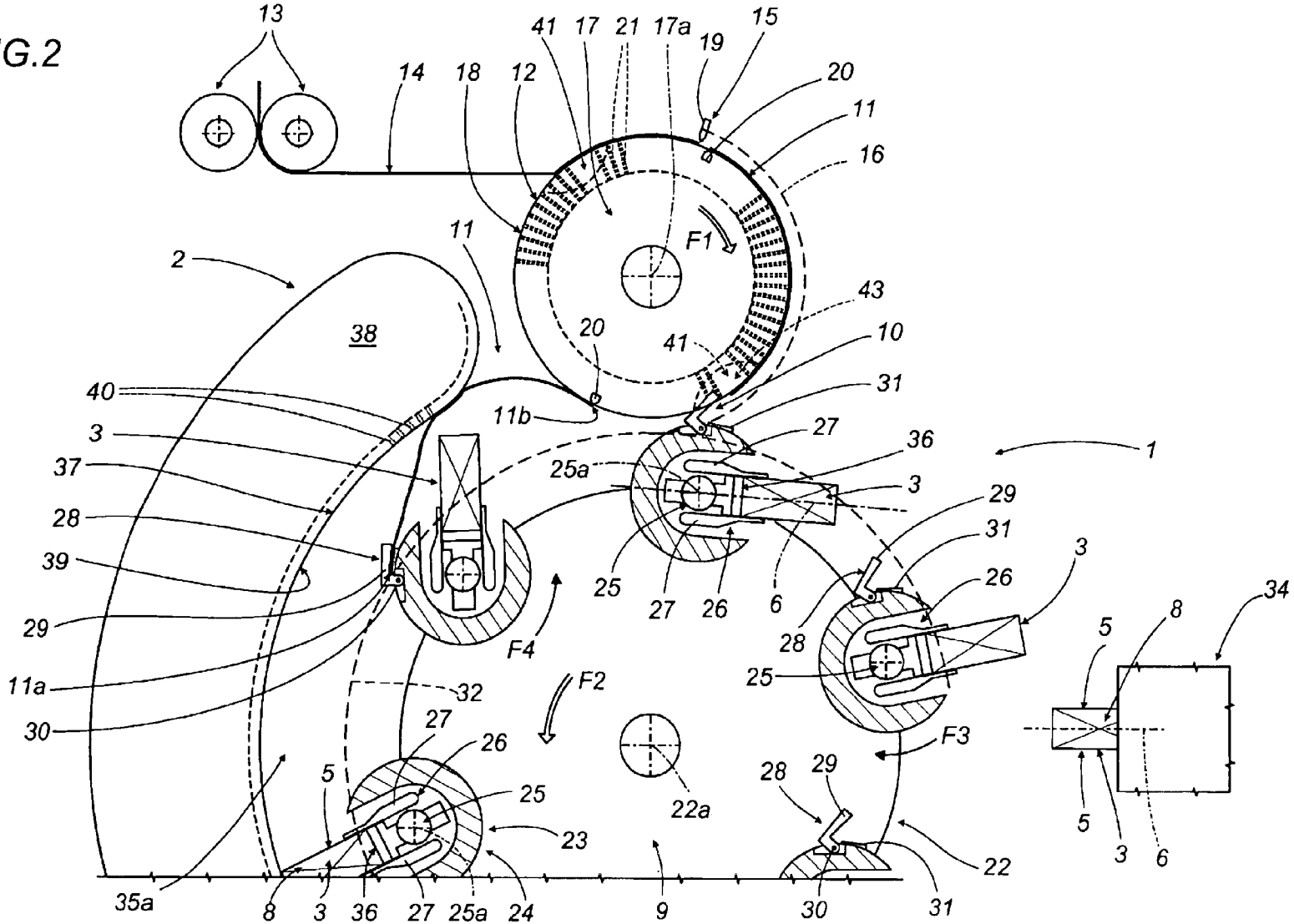
Figure 3:
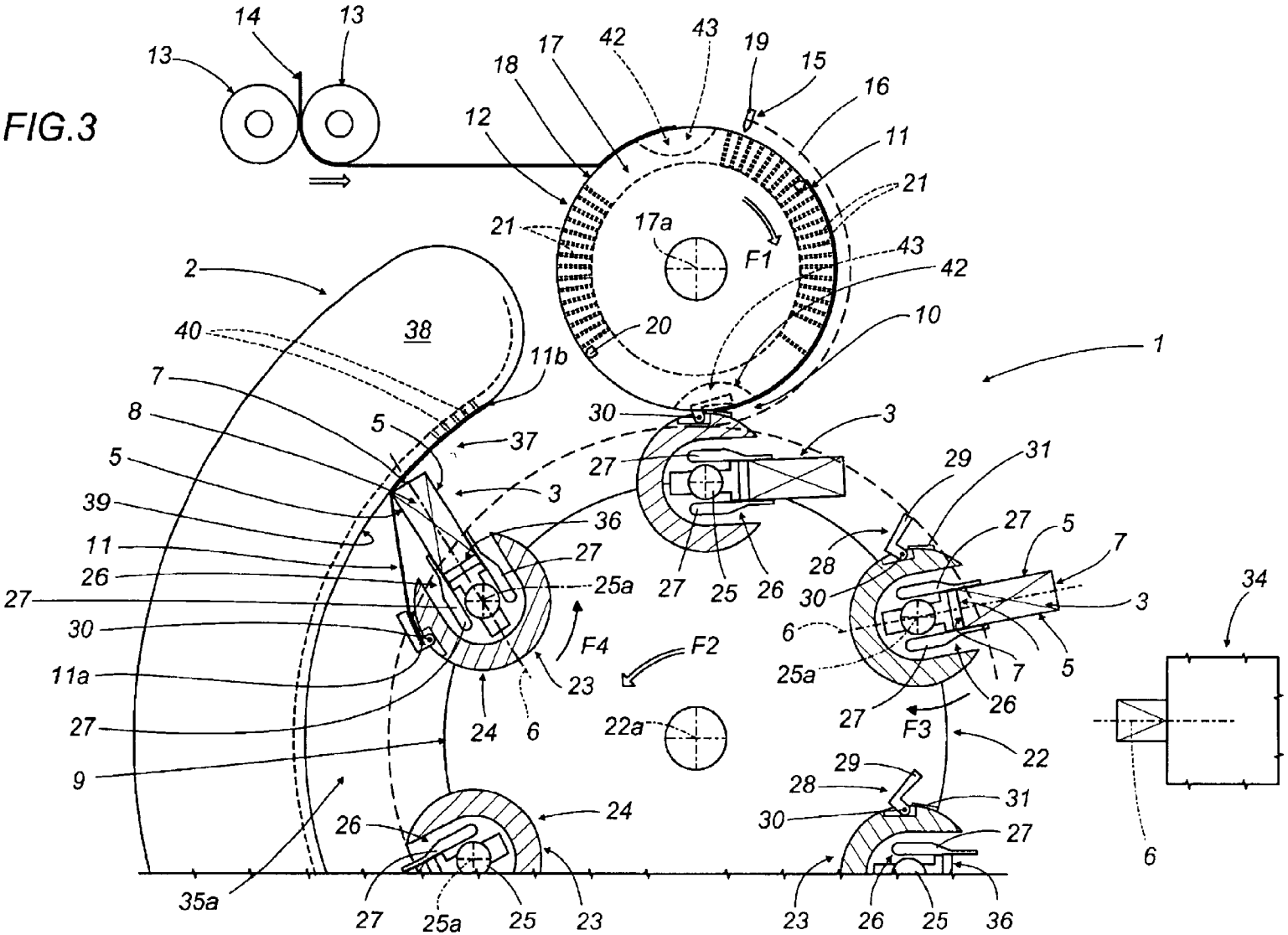
Figure 7:
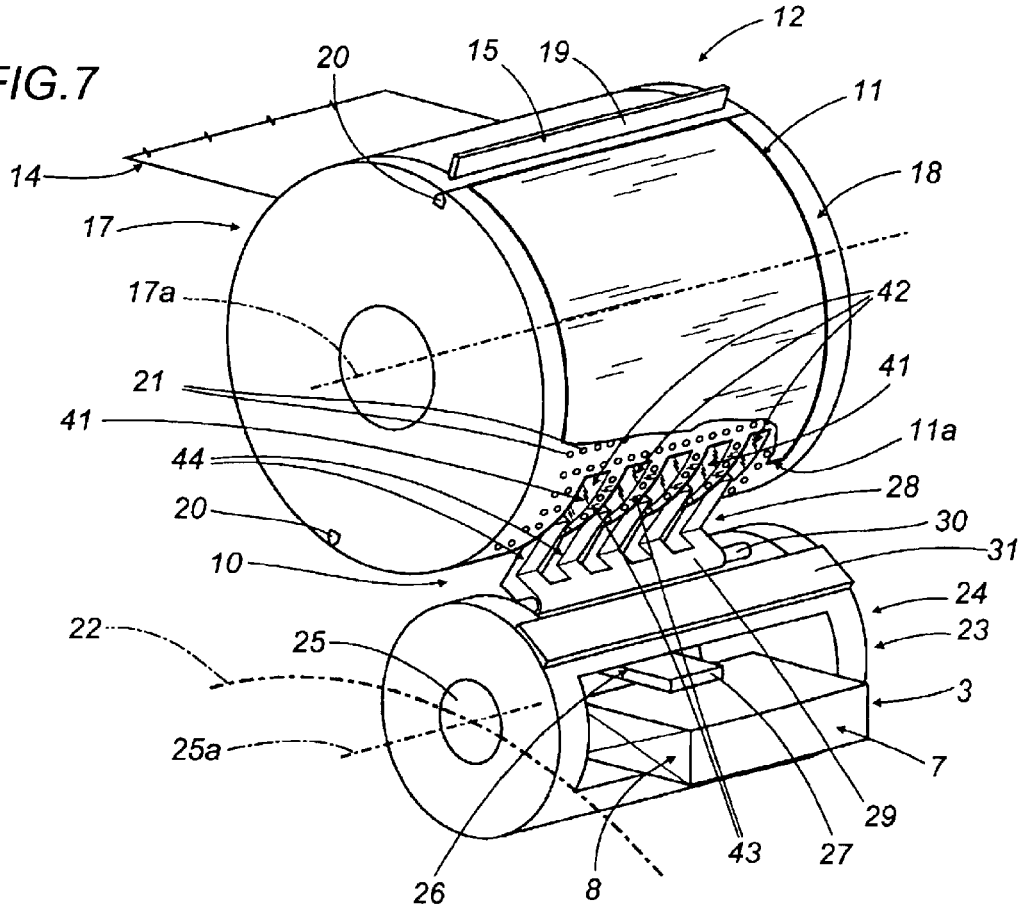
FIG. 7 is an enlarged detail of the overwrapping unit illustrated in FIGS. 1 to 4 and in FIG. 6, viewed schematically in perspective.

It will be observed, with reference in particular to FIGS. 2, 3 and 7, that the cylindrical outer surface 18 of the suction roller 17 presents two angularly equidistant openings 41 serving to admit and afford a passage to the movable jaw 29 of the gripping means 28. More exactly, each opening 41 appears as a plurality of grooves 42 formed in the cylindrical surface 18 of the roller 17 in such a way as to create a relative plurality of intercalated sectors 43, each presenting a given number of the aforementioned suction holes 21 on its cylindrical surface. The roller 17 is timed in such a manner that the leading end 11*a* of each leaf 11 will be positioned over and retained by the sectors 43 of a relative opening 41, in readiness to be taken up by the gripping means 28.

In particular, the movable jaw 29 of the gripping means 28 appears as a pallet and is furnished with a plurality of fingers 44 which on arrival at the assembly station 10 are able to locate in and pass along the grooves 42 in such a way as to detach the leading end 11*a* of the leaf 11 from the sectors 43 and pin it against the fixed jaw 31.

Figure 1:
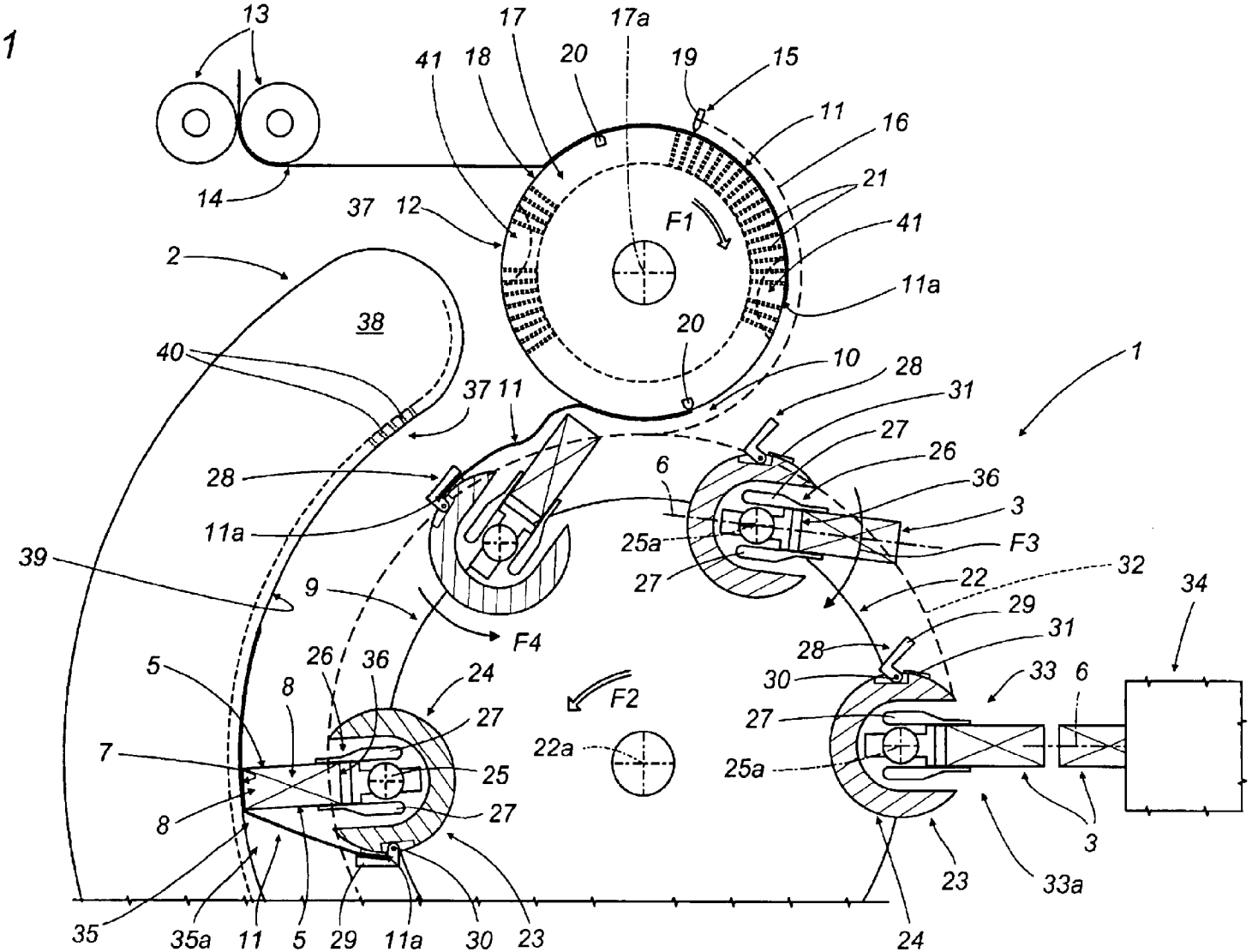
FIGS. 1 to 4 show a first preferred embodiment of the unit for overwrapping packets according to the invention, illustrated schematically in a side elevation with certain parts omitted and seen in a succession of operating steps.

In operation, with the folder wheel 22 moving in the conveying direction F2 about its axis 22*a* of rotation, each carrier 23 is brought into alignment with the entry position 33 (FIG. 1), whereupon a packet 3 is directed by the feed device 34 against the locating surface 36 and between the jaws 27, which close against the larger side faces 5 of the packet 3 to apply the gripping action. Proceeding along the second path 32 and through an arc that extends from the entry station 33 to the folding position 35, each carrier 23 will pivot about the relative axis 25*a* first in a direction F3 contrary to the direction of rotation F2 of the wheel 22, to the point at which the packet 3 assumes a position of minimum radial projection. In this position, the packet 3 is disposed with its transverse axis 6 substantially tangential to the periphery of the wheel 22 (FIG. 1). The position of minimum radial projection is maintained during the passage of the carrier 23 through the assembly station 10 and for the duration of the step whereby the end 11*a* of the leaf 11 of material is pinned by the movable jaw 29 against the fixed jaw 31, in the manner described above and illustrated sequentially in FIGS. 2, 3 and 4, so that the packet 3 makes no contact with the roller 17 when passing through and beyond the station 10.

Figure 4:
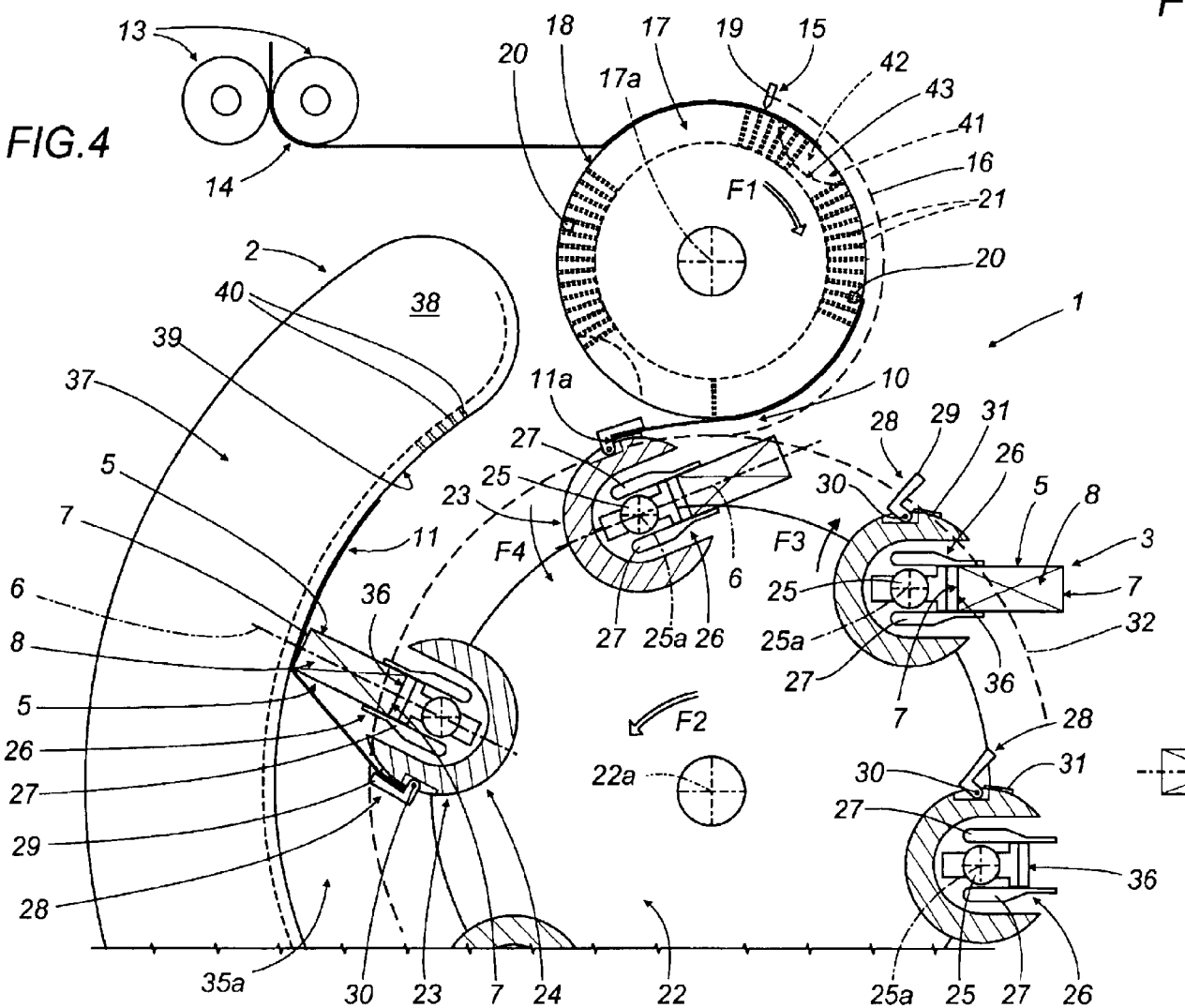

Once past the assembly station 10, as discernible in particular from FIGS. 3 and 4, the carrier 23 is made to pivot in a direction F4 convergent with the direction of rotation F2 of the wheel 22, so that by the time the folding position 35 has been assumed, the advancing packet 3 will have returned to its position of maximum radial projection from the wheel 22, in this instance with the outwardly directed smaller side face 7 offered substantially in contact to the aspirating surface 39 of the restraint 38.

Observing the sequence of steps illustrated in FIGS. 1 to 4, it will be seen that the end 11*a* of each leaf 11 continues to be held throughout the steps of being taken up and detached progressively from the surface 18 of the suction roller 17, and during its passage toward the folding position 35. Moreover, the position of the leaf 11 is controlled first by the roller 17 and subsequently, during its gradual separation from the cylindrical surface 18, by the initial stretch of the aspirating surface 39 of the restraint 38 as indicated in FIG. 2, which shows an intermediate portion of the leaf 11 held by this same stretch of the aspirating surface 39, while the trailing end 11*b* of the leaf 11 opposite to the gripped leading end 11*a* is still retained by the surface 18 of the suction roller 17.

As the folder wheel 22 continues rotating on its axis 22*a* and the carrier 23 continues to pivot in the direction denoted F4 about the axis 25*a* of the respective shaft 25, the trailing end 11*b* of the leaf 11 detaches from the surface 18 of the suction roller 17 but will be taken up immediately onto the aspirating surface 39 of the shroud 38, along which it then slides (FIGS. 3 and 4) until in alignment with the folding position 35, as illustrated in FIG. 1, thence toward the aforementioned release and transfer station (not illustrated).

As discernible from FIGS. 1, 2 and 3, and from FIG. 7, the peripheral velocity of the suction roller 17 is faster than the decoil rate imposed by the pinch rolls 13, so that each leaf 11 separated by the cutter will be distanced from the leading edge of the continuous strip 14, which continues to cling to the roller 17 but is forced to slip on the relative surface 18.

In the example of FIG. 6, the suction roller 17 comprises a hub 45 rotatable about the relative axis 17*a* and presenting two angularly equidistant bosses 46 serving both as support elements for the aforementioned strikers 20, and as mountings for relative pivots 47 disposed parallel to the roller axis 17*a* and supporting two semicircular sectors 48 that combine to make up the cylindrical surface 18 of the suction roller 17.

The two pivots 47, are connected mechanically to actuator means 49, represented schematically by a block, such as will cause each sector 48 to rock on the relative pivot 47 between an at-rest position, concentric with the roller axis 17*a,* and an open position assumed when passing through the assembly station 10 in such a way as to bring the leading end 11*a* of the leaf 11 substantially into contact with the gripping means 28, of which the jaws 29 and 31 operate in the manner already indicated, the two sectors 48 being furnished both with suction holes 21 and with openings 41 as in the case of the embodiment described above. It will be appreciated that the suction holes 21 can be connected to the source of negative pressure (not illustrated) by way of flexible pipelines (not illustrated) such as will allow the sectors 48 to assume the two limit positions unhindered, or alternatively, by way of ducts routed through the pivots 47.

What is claimed:

1. A unit for overwrapping packets, comprising: a unit for transferring packets through an assembly station where the packets are united with leaves of wrapping material, and successively through a folding station where the selfsame leaves are bent around the packets; a cutter device to cut the wrapping material fed and to form the leaves; feed means to advance the leaves along a first path the feed means comprising a conveyor set in motion continuously along the first path while restraining the leaves advanced along the selfsame path, and the transfer unit comprising a plurality of carriers supporting the packets, each equipped with means to grip one end of at least one of the leaves of material adhering to the conveyor and detach it progressively from the selfsame conveyor before effecting art initial step of folding this latter partly around a relative packet, the conveyor comprising a suction roller set in rotation continuously about a relative axis, wherein the suction roller comprises a cylindrical surface having at least one opening, and each carrier of the transfer unit comprising respective gripping means having respective moveable jaws engageable with the opening of the suction roller.

2. A unit as in claim 1, wherein the transfer unit comprises a folder wheel set in rotation continuously about an axis parallel to the axis of rotation of the suction roller, and the carriers are associated with the periphery of the wheel, capable of movement thus along a second path passing through the assembly station substantially tangential to the first path.

3. A unit as in claim 1, wherein the suction roller presents at least one striker operating in conjunction with the blade of a cutter device by which the leaves are separated from a continuous strip.

4. A device as in claim 1, wherein the opening consists a plurality of grooves formed in the cylindrical surface of the roller, and the movable jaw of the gripping means appears as a pallet furnished with a plurality of fingers insertable into the grooves in such a manner as to detach and thereupon, operating in conjunction with a second jaw rigidly associated with the carrier, to grip one end of a leaf of wrapping material clinging to the cylindrical surface of the roller in a position coinciding with the opening.

5. A unit as in claim 1, wherein each of the carriers supporting the packets comprises a block supporting a relative gripper serving to hold the packet, and while advancing along the second path is also pivotable on a shaft about a relative axis disposed parallel to the axis of rotation of the folder wheel, between at least two limit positions of which a first is assumed both at a position in which the packet is admitted by the gripper at a folding positions, and a second is assumed during the passage of the carrier along a part of the second path lying substantially tangential to the first path, the second limit position coinciding with a position of minimum radial projection assumed by the packet relative to the folder wheel.

6. A unit as in claim 5, wherein the first limit position coincides with a position of maximum radial projection assumed by the packet relative to the folder wheel.

7. A unit as in claim 5, wherein each carrier is pivotably engaged to the transfer unit to rotate about a relative axis, each carrier covering an arc of the second path extending from the admission position to the folding position, each carrier rotating first in a direction contrary to the direction of rotation of the folder wheel, and each packet assuming and maintaining the position of minimum radial projection until beyond the assembly station, and thereafter in a direction convergent with the direction of rotation of the wheel until in alignment with the folding position.

8. A unit as in claim 1, also comprising fixed guide and folder and suction means located downstream of the assembly station, relative to the direction of the transfer unit, serving to retain a portion of each leaf and to effect a first partial fold of the selfsame leaf around the packet at a first folding station.

9. A unit as in claim 1, wherein the suction roller presents a hub rotatable about the relative axis and presenting two angularly equidistant bosses pivotably supporting two semicircular sectors combining to make up the cylindrical surface of the roller, each pivotable between an at-reset position, concentric with the roller axis, and open position assumed when occupying the assembly station at a moment coinciding with proximity of the gripping means.

10. A unit as in claim 1, wherein each of the carriers supporting the packets comprises a block supporting a relative gripper serving to hold the packet, and while advancing along the second path is also pivotable on a shaft about a relative axis disposed parallel to the axis of rotation of the folder wheel, between at least two limit positions of which a first is assumed both at a position in which the packet is admitted by the gripper and a folding position, and a second is assumed during the passage of the carrier along a part of the second path lying substantially tangential to the first path, the second limit position coinciding with a position of minimum radial projection assumed by the packet relative to the folder wheel.

11. A unit as in claim 2, wherein each of the carrier supporting the packets comprises a block supporting a relative gripper serving to hold the packet, and while advancing along the second path is also pivotable on a shaft about a relative axis disposed parallel to the axis of rotation of the folder wheel, between at least two limit positions of which a first is assumed both at a position in which the packet is admitted by the gripper and at a folding position, and a second is assumed during the passage of the carrier along a part of the second path lying substantially tangential to the first path, the second limit position coinciding with a position of minimum radial projection assumed by the packet relative to the folder wheel.

12. A unit as in claim 3, wherein each of the carriers supporting the packets comprises a block supporting a relative gripper serving to hold the packet, and while advancing along the second path is also pivotable on a shaft about a relative axis disposed parallel to the axis of rotation of the folder wheel, between at least two limit positions of which a first is assumed both at a position in which the packet is admitted by the gripper and at a folding position, and a second is assumed during the passage of the carrier along a part of the second path lying substantially tangential to the first path, the second limit position coinciding with a position of minimum radial projection assumed by the packet relative to the folder wheel.

13. A unit as in claim 1, wherein each of the carriers supporting the packets comprises a block supporting a relative gripper serving to hold the packet, and while advancing along the second path is also pivotable on a shaft about a relative axis disposed parallel to the axis of rotation of the folder wheel, between at least two limit position of which a first is assumed both at a position in which the packet is admitted by the gripper and at a folding position, and a second is assumed during the passage of the carrier along a part of the second path lying substantially tangential to the first path, the second limit position coinciding with a position of minimum radial projection assumed by the packet relative to the folder wheel.

14. A unit as in claim 4, wherein each of the carriers supporting the packets comprises a block supporting a relative gripper serving to hold the packet, and while advancing along the second path is also pivotable on a shaft about a relative axis disposed parallel to the axis of rotation of the folder wheel, between at least two limit positions of which a first is assumed both at a position in which the packet is admitted by the gripper and at a folding position, and a second is assumed during the passage of the carrier along a part of the second path lying substantially tangential to the first path, the second limit position coinciding with a position of minimum radial projection assumed by the packet relative to the folder wheel.

15. A unit as in claim 1, also comprising fixed guide folder and suction means located downstream of the assembly station, relative to the direction of the transfer unit, serving to retain a portion of each leaf and to effect a first partial fold of the selfsame leaf around the packet at a first folding station.

16. A unit as in claim 2, also comprising fixed guide and folder and suction means located downstream of the assembly station, relative to the direction of the transfer unit, serving to retain a portion of each leaf and to effect a first partial fold of the selfsame leaf around the packet at a first folding station.

17. A unit as in claim 3, also comprising fixed guide and folder and suction means located downstream of the assembly station, relative to the direction of the transfer unit, serving to retain a portion of each leaf and to effect a first partial fold of the selfsame leaf around the packet at a first folding station.

18. A unit as in claim 1, also comprising fixed guide and folder and suction means located downstream of the assembly station, relative to the direction of the transfer unit, serving to retain a portion of each leaf and to effect a first partial fold of the selfsame leaf around the packet at a first folding station.

* * * * *